United States Patent [19]

Zocco

[11] Patent Number: 5,065,485

[45] Date of Patent: Nov. 19, 1991

[54] ENCLOSED INNERSPRING MATTRESS COVER AND PROCESS FOR ASSEMBLING SAME

[76] Inventor: George Zocco, 1345 Burlington Rd., Virginia Beach, Va. 23464

[21] Appl. No.: 480,315

[22] Filed: Feb. 15, 1990

[51] Int. Cl.[5] ..... B68G 7/00

[52] U.S. Cl. ..... 29/91.1; 29/525.1; 5/470; 5/474

[58] Field of Search ..... 5/448, 470, 474, 475; 29/91, 91.1, 525.1

[56] References Cited

U.S. PATENT DOCUMENTS

| | | | |
|---|---|---|---|
| 3,040,473 | 6/1962 | Wetzler | 5/470 |
| 3,262,135 | 7/1966 | Fasanella | 5/474 |
| 3,287,749 | 11/1966 | Marsico | 5/470 |
| 3,441,994 | 5/1969 | Wylie | 29/91 |
| 3,493,980 | 2/1970 | Haller | 5/470 |
| 3,950,800 | 4/1976 | Garshfield | 5/470 |
| 4,187,566 | 2/1980 | Peterson | 5/474 |
| 4,429,427 | 2/1984 | Sklar | 5/474 |
| 4,706,313 | 11/1987 | Murphy | 5/470 |
| 4,868,941 | 9/1989 | Tai | 5/470 |
| 4,955,095 | 9/1990 | Gerrick | 5/470 |

FOREIGN PATENT DOCUMENTS

| | | | |
|---|---|---|---|
| 550815 | 12/1957 | Canada | 5/470 |
| 2910216 | 9/1980 | Fed. Rep. of Germany | 5/475 |
| 3223770 | 6/1983 | Fed. Rep. of Germany | 5/470 |
| 64032 | 4/1953 | France | 5/470 |
| 71546 | 5/1957 | France | 5/475 |
| 1286299 | 8/1972 | United Kingdom | 5/470 |

*Primary Examiner*—Gary L. Smith
*Assistant Examiner*—F. Saether

[57] ABSTRACT

Encased innerspring mattress and cover device is assembled by positioning mattress and cover component layers, one atop the other, in sequential order, (namely mattress cover bottom, bottom panel, filling material, insulator, innerspring, insulator, filling material, top panel, and mattress cover top, respectively). Continuous zipper at perimeter of mattress cover allows mattress cover to be completely assembled prior to its attachment to the innerspring mattress interior components. Entire mattress and cover assembly can be manufactured from the bottom up without overturning any interior components of the device during its assembly.

7 Claims, 4 Drawing Sheets

ENCLOSED INNERSPRING MATTRESS COVER AND PROCESS FOR ASSEMBLING SAME

FIELD OF INVENTION

The present invention relates to bed mattresses, and in particular to a process for manufacturing a modular mattress.

BACKGROUND

Prior methods of assembling an innerspring mattress typically involve the following operations:

The materials used in the construction are fed to (or otherwise gathered by) a person called an "assembler". A work table is typically needed. If the table is stationary, the assembler walks around the table as necessary to perform the mattress-assembly operations. If the table is a swivel-type table, the assembler stands at one area and swivels the table around. (As can be appreciated from the following description, prior methods of assembling innerspring mattresses required the assembler to work all around the perimeter of the mattress.)

Next, an innerspring is placed on the table. If the spring calls for edge supports, the supports must typically be attached first. This is typically done by the use of an air-tool. The air tool is called a Hog-Ring Gun or a clipping gun. The gun is controlled by a trigger and is powered by air. The gun is heavy and dangerous and is frequently the cause of injuries. The gun releases a U-shaped clip which engages a coil spring or a border rod of the innerspring; and then, with the force of air, the jaws of the gun crimp the clip into a closed O-shaped loop.

The assembler must first apply and clip an "insulator" to the innerspring to keep it from shifting. Then, the assembler lays out a "filling material". The filling material could be either a single layer or multiple layers of combined cushioning such as cotton, foam, poly-foam, wool, polyester, or garment fibers. Then all these filling components are laid out evenly over the sub-assembly, (which is already covered with the insulator). The filling material must cover the edges of the innerspring sub-assembly.

The assembler then begins installation of a "top panel". The top panel would typically already have had a strip of cloth material sewn onto it with approximately four inches hanging all around the edge of the panel. This strip of material that hangs over the top panel is called the "flange cloth". The assembler must place this panel over all the filling material and square all four corners of the panel. The assembler then clips each corner of the flange cloth to the corner coils in order to hold the panel in place as he flips the entire half-assembled innerspring sub-assembly over so that he can attach (clip) the flange cloth to every coil of the innerspring perimeter. However, before he starts the clipping operation, he must constantly pull and tuck the material and the top panel so it sits evenly and square, and so that the corners are square to the ends and sides of the assembly. All the filling material must be under the four inch flange cloth. Once that side is completed, the same process must be duplicated for the second side of the sub-assembly. Then the four corner coils must be filled up—in order to produce full and rounded corners. Then the mattress border must be placed around the perimeter. Then the completed mattress must be physically picked up and placed onto a skid, table or conveyor.

Typically, all of the above-described operations are manually performed by the assembler. The above-described operation is physically demanding, difficult and dangerous. It takes months to train an assembler. And even after properly trained, production is slow and laborious, which results high costs.

Prior methods of innerspring mattress cover assembly and tape edging typically involve an "operator", a large table, and a sewing head attached to a carriage. The carriage portion typically comprises a motor and drive belts. The table typically has a toothed rail which engages with a drive gear. The carriage portion also contains a brake which the operator regulates by pushing in with his knee. With the switch turned on, the machine automatically moves around the table.

The operator typically first picks up the mattress off of a skid, table or conveyor and places it on the table and positions it so that he can start joining the border to one of the above-described panels. Typically, the operator only has ¾" or less of the panel edge to hold onto. He pulls the panel edge by hand into a "binder" which contains the binding (i.e. tape). At the same time, he must pull upward on the border and feed it into the binder with his other hand.

After the first side is sewn, the operator must flip the entire mattress sub-assembly over and then repeat the sequence. Assembly of the second side of the mattress cover is even more difficult than the first, because the border has already been sewn to one side. Thus, the edge of the mattress must be pushed down with one of the operator's elbow and arm, while the he pulls up on the border and struggles to get it into the binder with his other hand.

After the mattress is bound (i.e. taped) on both sides, it then must be picked up again and placed into position for inspection and packing. It is noted that the typical prior method of mattress cover assembly requires that the entire mattress assembly to be picked up to be placed on the table for taping, then flipped over so that the second side may be taped, then picked up again and placed for final inspection and packing. The prior laborious mattress cover assembly procedure is the most difficult procedure involved in the assembly of a mattress. It typically takes years to train a good operator to assemble mattress covers using prior assembly methods.

Additionally, because of the difficulty involved in the labor-intensive prior methods of mattress cover assembly, operators have frequently suffered from distorted fingers and diseases of the hands, and from injured backs.

Furthermore, the equipment used in the prior methods of mattress cover assembling is expensive and typically requires constant care and maintenance.

OBJECTS

Accordingly, it is an object of the present invention to provide a process for assembling an innerspring mattress cover which is less physically demanding, less difficult and less dangerous than prior methods of assembling innerspring mattress covers.

Another object of the present invention is to provide a process of the character described which requires less operator training than prior methods of innerspring mattress cover assembly.

Another object of the present invention is to provide a process of the character described which is faster, easier and lower cost than prior methods of innerspring mattress cover assembly.

It is another object of the present invention to provide a process of the character described which does not necessitate the use of dangerous tools or the use of expensive equipment.

It is another object of the present invention to provide a process of the character described which does not require any heavy lifting.

It is another object of the present invention to provide a new mattress cover construction which is manufactured using this new manufacturing process.

Further objects and advantages of may invention will become apparent from a consideration of the drawings and ensuing description thereof.

DRAWINGS

DESCRIPTION OF THE PREFERRED EMBODIMENT

The present invention provides a method of assembling a cover fabric, or similar material, to an innerspring mattress subassembly. In the preferred embodiment of the invention, the mattress cover is constructed to enclose a generally rectangular-shaped innerspring mattress subassembly (100). However, it will be appreciated that the present invention is adaptable for use on differently shaped innerspring mattress subassemblies.

The preferred embodiment of the innerspring mattress subassembly is similar to the ENCLOSED INNERSPRING MATTRESS disclosed in my copending U. S. patent application Ser. No. 07/480,315, now abandonded.

Figure 1:
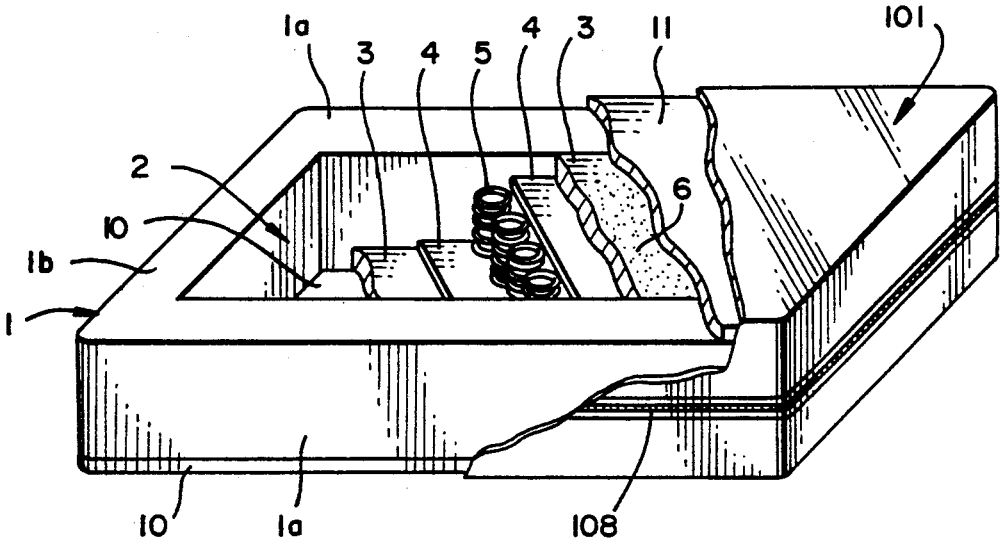
FIG. 1 is a perspective view of the present invention showing the interior components of the device.

Referring to FIG. 1: A from (1) which is made of any common poly-foam or latex foam material has two sides (1*a*) and two ends (1*b*).

The two sides (1*a*) and ends (1*b*) and bottom (10) are glued together, thereby effecting an opening (2) within the frame, as shown in FIG. 1.

Bottom (10) and top (11) panels are made of the same density foam. The frame (1), which is preferably made of higher density foam than the top (11) and bottom (10) panels, holds components of the invention within the frame (1) during assembly of the device, and also gives a person sleeping on the enclosed innerspring mattress subassembly (100) complete edge support, and 100% sleeping surface edge support.

A filling material (3) is then laid into the opening (2) in the frame. The filling material (3) may be made of any common mattress filling material, such as cotton, foam, poly-foam, wool or other fibers. The first layer of filling material (3) may be glued to the inside surface of the bottom panel (10). Either one or several layers of filling material may be used.

After the filling material (3) is placed inside of the frame (1), an innerspring insulator (4) is placed upon the filling material (3). The insulator (4) layer may be made of any common mattress insulator material, such as sisal, coconut fiber, burlap, resin-treated pads, or similar material. The insulator (4) prevents the filling material (3) from falling into the mattress spring (5) after the device has been assembled.

After the insulator (4) is placed inside of the frame (1), an innerspring (5) is placed inside of the frame, centered within the frame. At this point, it is useful to check to ensure that all the filling material (3) is evenly distributed inside of the frame (1) and, preferably, touches the sides (1*a*) and ends (1*b*) of the frame (1).

In reverse order to the above process, the second (i.e. top) half of the innerspring mattress subassembly (100) is manufactured. That is: A second insulator (4) is laid on top of the innerspring (5); then a second layer of filling material (3) is placed on top of the second insulator (4).

After the last layer of filling material (3) is applied, the entire exposed top exterior surface of the assembly, (i.e. the top of frame (1) and the top surface of filling material (3)), may be sprayed with glue (6), and is then covered with a top panel (11). Top panel (11) is preferably made of the same material as bottom panel (10).

It will be appreciated by those skilled in the art that the described procedure provides a mattress innerspring subassembly which is entirely encased (by the frame (1) and the top (10) and bottom (11) panels). Accordingly, it will be appreciated that the internal components of the device thus far described—(i.e. the insulator (3), the filling material (4), and the innerspring (5))—are prevented from shifting or otherwise becoming damaged during and after manufacture of the device.

In the preferred embodiment of the invention, the mattress cover, generally indicated as (101) in the drawings, may be a smooth plain fabric or a quilted fabric. The cover comprises a top fabric (102) and a bottom fabric (103) which are preferably similar in size and shape to each other. The size and shape of the top and bottom fabrics (102) and (103) are such that they large enough to fully cover the top and bottom of the innerspring subassembly, respectively.

Figure 4:
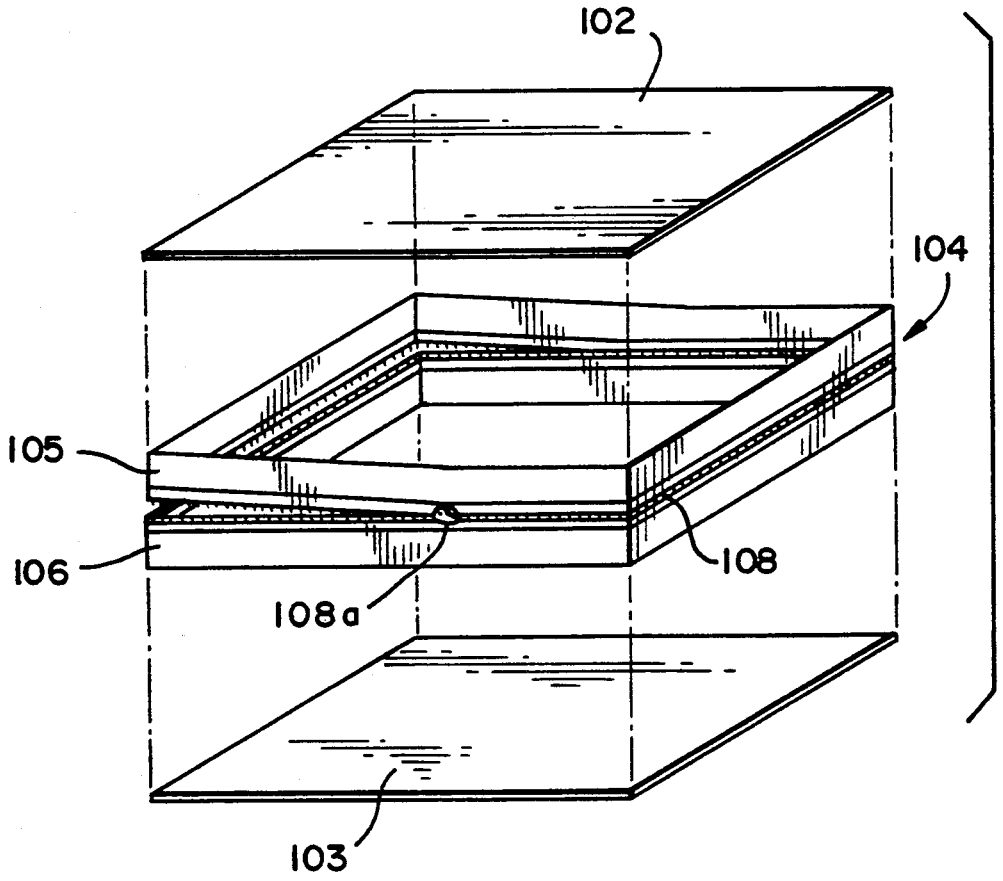
FIG. 4 is an exploded perspective view showing the preferred construction of the mattress cover subassembly.

Referring to FIG. 4: A mattress cover subassembly (104) is constructed of an upper segment (105) and a lower segment (106) which are preferably constructed of a fabric identical to, or similar to, that of the top fabric (102). The ends of the upper (105) and lower (106) border segments are sewn to an end piece (107). In the preferred embodiment of the invention top fabric (102), bottom fabric (103), upper (105) and lower (106) border segments, and border end piece (107) are all edge serged to eliminate any loose threads and to prevent the individual components from pulling apart after their assembly.

A continuous zipper (108), extending from end to end of the upper (105) and lower (106) border segments, is sewn to the matting edges of the upper (105) and lower (106) border segments. In the preferred embodiment of the invention, zipper (108) has two zipper pulls (108*a*) which facilitate opening and closing the border segments.

Also, in the preferred embodiment of the invention, the width of end piece (107) is less than the width of the end of the top fabric (201), thereby allowing the upper (105) and lower (106) border segments to be at least partially opened on every side of the mattress cover (101).

While a single zipper (108) having two pulls (108*a*) are used in the preferred embodiment of the invention as shown in FIG. 4, alternatively a single zipper using a single pull can be used.

In the preferred embodiment of the invention, the overall height of the border subassembly (104) is at least equal to the overall height of the innerspring mattress subassembly (100).

Figure 3:
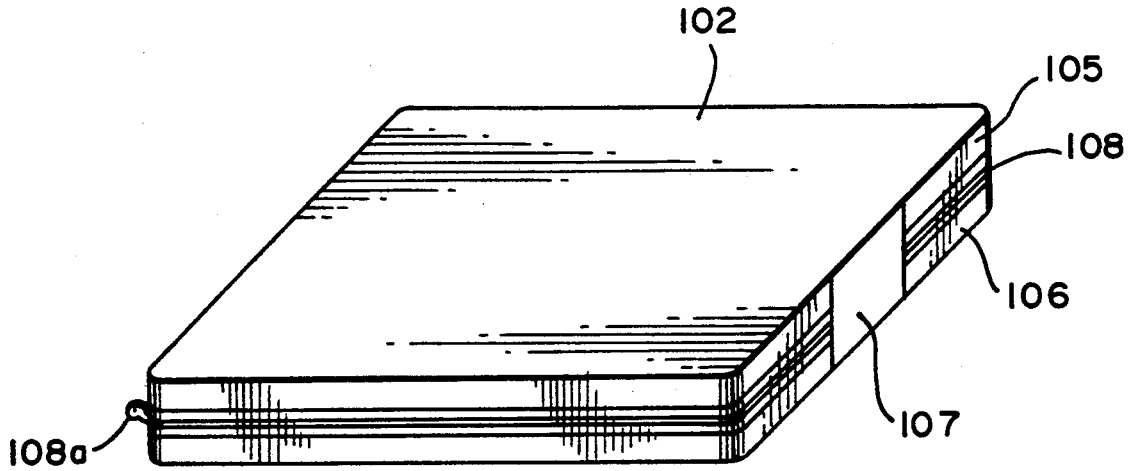
FIG. 3 is a perspective view of the fully-assembled present invention.
Figure 5:
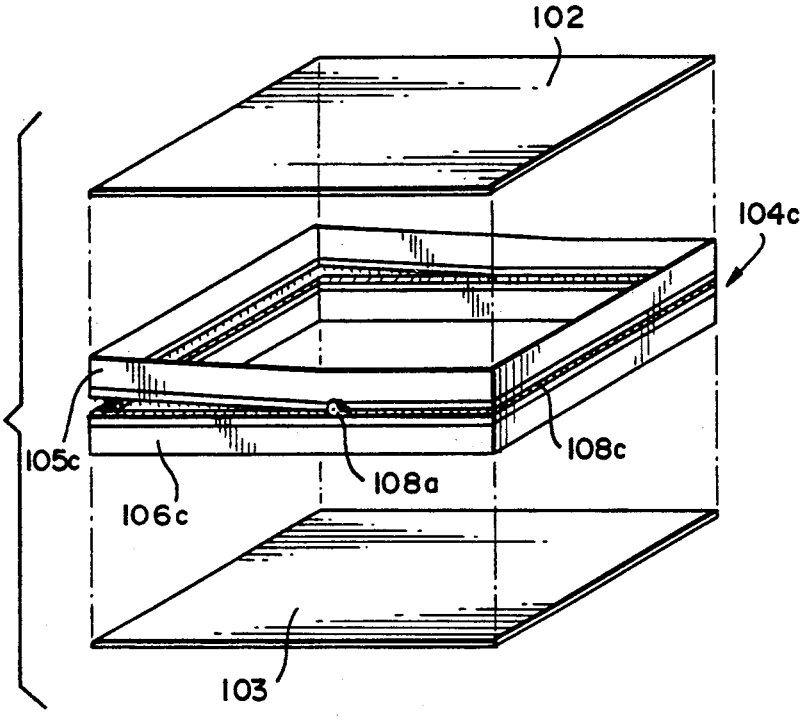
FIG. 5 is an exploded perspective view showing a modified construction of the mattress cover subassembly.

Also, in the preferred embodiment of the invention, end piece (107) is attached to the ends of upper (105) and lower (106) border segments (as shown in FIGS. 1, 3 and 4), in order to hold the two segments together when the parts are unzipped. However, a modified construction of the present invention comprises an endless zipper (108*c*) between facing edges of upper border segment (105*c*) and lower border segment (106*c*), (but no border end piece), as shown in FIG. 5. This modification of the border subassembly (104*c*) allows the upper segment (105*c*) to be completely detached from the lower segment (106*c*) by unzipping the zipper (108*c*).

Referring to FIGS. 3, 4 and 5: In the preferred embodiment of the invention mattress cover top fabric (102) is continuously sewn at its perimeter to the top of the border subassembly (104). Handling of the cover can be eased by using an air table (not shown) to help support the cover. It will be appreciated by those skilled in the art that the cover (101) can be completely sewn together in a room specifically set up for sewing, and that an unskilled sewing operator can produce the described cover (101) in a matter of minutes.

Figure 2:
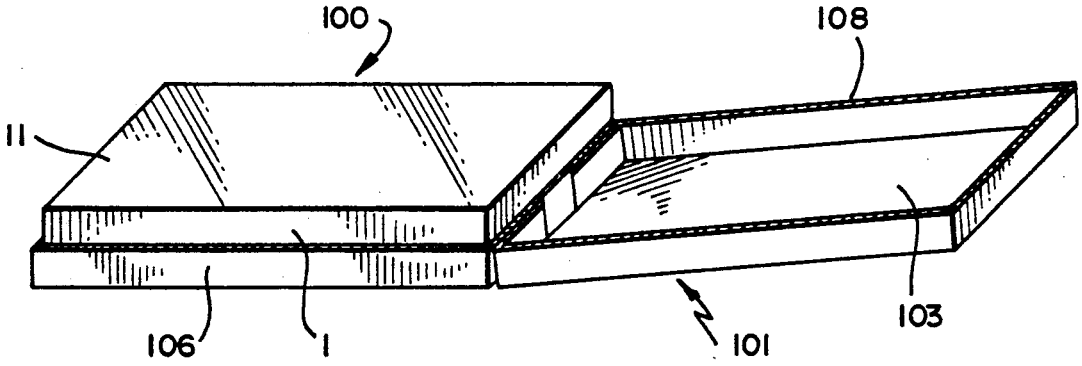
FIG. 2 is a perspective view of the present invention showing the mattress cover unzipped and laying open.

To assemble the mattress cover (101) to the innerspring mattress subassembly (100), Mattress cover (101) is unzipped and laid open as shown in FIG. 2. Innerspring mattress subassembly (100) is placed (or assembled) inside of the bottom half (i.e. the lower border segment (106) and bottom fabric (103) of the mattress cover. The top half (i.e. the upper border segment (105) and top fabric (102) of the mattress cover (101) can be placed over the top of the innerspring mattress subassembly (100) and zipped closed, as shown in FIGS. 1 and 3.

Also, in the preferred embodiment of the invention the height of each of the two border segments (105) and (106) are approximately equal—in which case the zipper (108) is disposed approximately in the center of the border subassembly (104). However, a modified border subassembly (104*a*) and (104*b*) may be constructed as shown in FIGS. 6 and 7, respectively.

Figure 6:
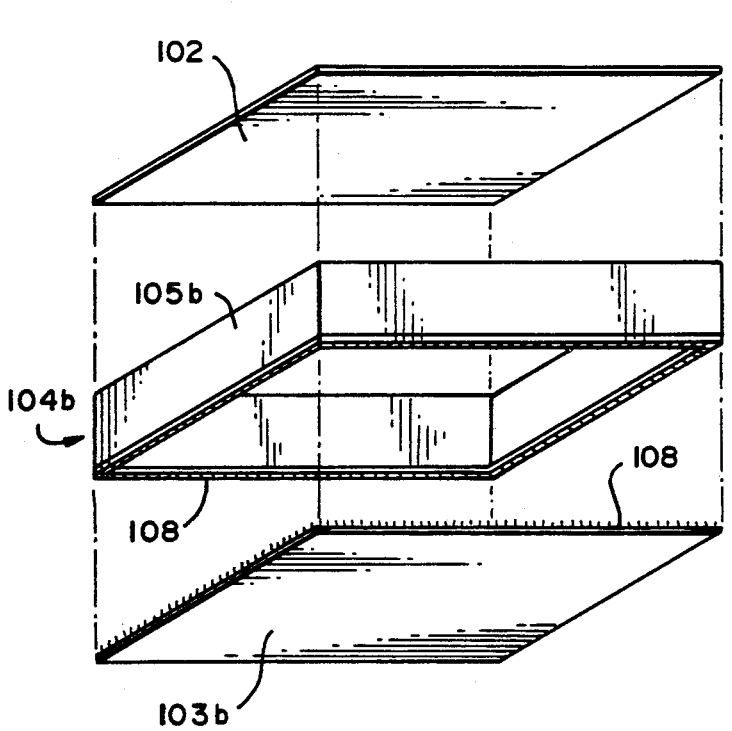
FIG. 6 is an exploded perspective view showing a modified construction of the mattress cover subassembly.
Figure 7:
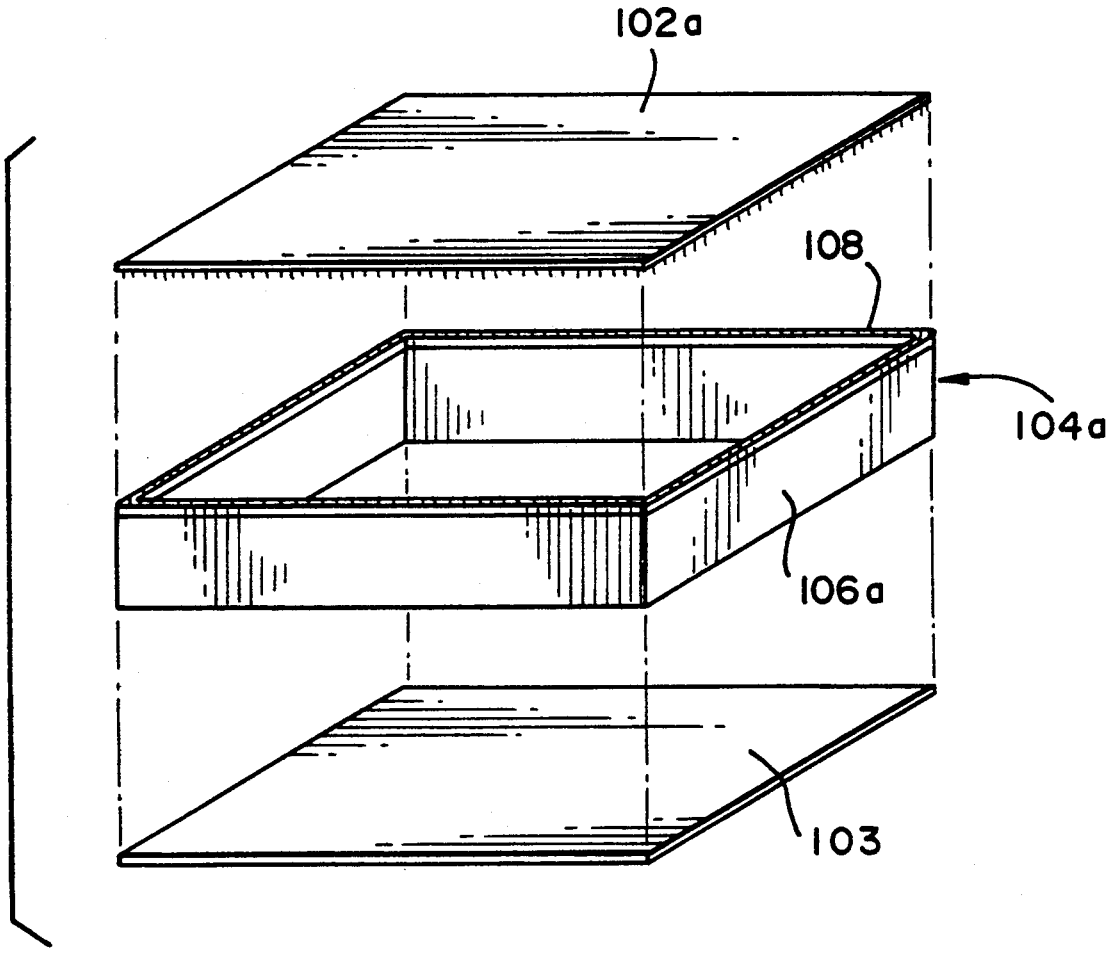
FIG. 7 is an exploded perspective view showing a modified construction of the mattress cover subassembly.

FIG. 6 shows a modified mattress cover construction wherein a zipper (108) is sewn directly to modified bottom fabric (103*b*) and modified upper border segment (105*b*). The top of the modified upper border segment (105*b*) is sewn to the perimeter of top fabric (102). (in this modified construction of the mattress cover, it is not necessary to use a lower border segment, such as part 106.) FIG. 7 shows a modified mattress cover construction similar to that shown in FIG. 6, except that the zipper (108) is attached to the modified fabric (102*a*) and the modified lower border segment (106*a*).

The preferred procedure for assembling the present invention is summarized as follows:

Zipper (108) is first sewn to corresponding edges of the upper (105) and lower (106) border segments.

The end piece (107) is then sewn to the ends of the upper (105) and lower (106) border segments.

The perimeters of the top fabric (102) and the bottom fabric (103) are then sewn to the top and bottom of the border subassembly (104), respectively.

Next, the border subassembly (104) is unzipped and the open mattress cover (101) is laid out (as shown in FIG. 2).

Then the innerspring mattress frame (1) and the bottom panel (10) are laid inside of the bottom half of the mattress cover (101).

Glue is then applied to the top surface of the bottom panel (10), and the filling material (3) is laid on top of the bottom panel.

The innerspring insulator (4) is then laid on top of the filling material (3).

Next, the mattress spring (5) is placed on top of the innerspring insulator.

Then the (second) innerspring insulator (4) is laid on top of the mattress spring (5).

Then a second layer of filling material (3) is laid on top of the (second) innerspring insulator (4).

Glue is then applied to the top surface of the second layer of filling material (3) and to the top surface of the innerspring mattress frame (1).

The top panel (11) is then attached to the top of the frame (1).

Finally, the top half of the mattress cover (101) is pulled over the mattress innerspring subassembly (100), and the zipper (108) is pulled closed.

It will be appreciated that the assembly procedure and construction thus described, discloses a method to fully assemble a mattress cover to an innerspring mattress subassembly.

It will be appreciated by those skilled in the art that the described method of assembling the mattress cover (1) to the innerspring subassembly (100) reduces the physical requirements of operators and assemblers which were necessary in prior mattress assemblies. It is particularly noted that the described method of mattress assembly does not require the mattress assembly, or the innerspring mattress subassembly, to be lifted and turned over while the cover is assembled to the innerspring subassembly.

It will also be appreciated that the disclosed mattress cover (101) can be removed and replaced with a similar sized mattress cover by the consumer, for example when the cover is soiled or damaged, without necessitating the replacement of the mattress' interior components.

While the above description contains many specificities, these should not be construed as limitations on the scope of the invention, but rather as an exemplification of on preferred embodiment thereof. Many other variation are possible, for example:

The frame (1) can be molded, formed, or otherwise constructed from a single piece of material;

An enclosed innerspring mattress of essentially the character of the preferred embodiment can be constructed without gluing of the filling material to the top and bottom panels; and The top and bottom panels (10) and (11) may be made of sufficiently thick material that an enclosed innerspring mattress of essentially the character of the preferred embodiment can be constructed without a filler material (3) or insulator (4); and The border subassembly (104), and the top (102) and bottom (103) mattress cover fabrics can be of diffeent materials from one another.

Accordingly, the scope of the invention should be determined not by the embodiment illustrated, but by the appended claims and their legal equivalents.

I claim:

1. A process for manufacturing a mattress device having an innerspring member having a top and bottom surface, an endless compressible frame member having a top surface and a bottom surface and an inside and an outside, a bottom panel member having a top surface and a bottom surface, and a top panel member having a top surface and a bottom surface, first and second fastening means, first and second border fabrics, and first and second cover fabrics, comprising the steps of:

attaching the first fastening means to a first edge of the first border fabric then attaching a second edge of said first border fabric to the first cover fabric;

attaching the second fastening means to a first edge of the second border fabric then attaching a second edge of said second border fabric to the second cover fabric;

permanently securing the top said bottom panel member to the bottom of said compressible frame member, wherein said compressible frame member comprises a compressible foam material;

positioning the bottom panel member and frame member inside said first border fabric and on top of said first cover fabric;

then positioning said innerspring member inside of said compressible frame member and on top of said compressible frame member;

then securing said first and second fastening means enclosing said top panel member, said bottom panel member, and said compressible frame with a covering means;

wherein the top of said innerspring member and the top of said bottom panel member are each upwardly directed during said step of positioning said innerspring member inside of said compressible frame member and on top of said panel member;

wherein in the top of said bottom panel member and the top of said compressible frame member are each upwardly directed during said step of securing the top of said bottom panel member to the bottom of said compressible frame member;

wherein the tops of said bottom panel member, said top panel member, said compressible frame member and said innerspring member are all upwardly directed during said step of securing the bottom of said top panel member to the top of said compressible frame member.

2. The process according to claim 1 further comprising positioning a first insulator member on top of said first compressible filler member prior to said step of positioning said innerspring member inside of said compressible frame member and on top of said bottom panel member.

3. The process according to claim 2, further comprising positioning a second insulator member on top of said innerspring member.

4. The process according to claim 3, further comprising positioning a second compressible filler member on top of said second insulator member.

5. The process according to claim 4 wherein said step of securing the top of said bottom panel member to the bottom of said compressible frame member comprises applying an adhesive between said bottom panel member and said compressible frame member.

6. The process according to claim 5, wherein said step of securing the bottom of said top panel member to the top of said compressible frame member comprises applying an adhesive between said top panel member and said compressible frame member.

7. A process for manufacturing a mattress device having an innerspring member having a top and bottom surface, an endless compressible frame member having a top surface and a bottom surface and an inside and an outside, a bottom panel member having a top surface and a bottom surface, a top panel member having a top surface and a bottom surface, first and second fastening means, first and second border fabrics, and first and second cover fabrics, comprising the steps of;

attaching the first fastening means to a first edge of the first border fabric then attaching a second edge of said first border fabric to the first cover fabric;

attaching the second fastening means to a first edge of the second border fabric then attaching a second edge of said second border fabric to the second cover fabric;

permanently securing the top of said bottom panel member to the bottom of said compressible frame member, wherein said compressible frame member comprises a compressible foam material;

positioning the bottom panel member and frame member inside said first border fabric and on top of said first cover fabric;

positioning a first compressible filler member on top of said bottom panel member;

positioning a first insulator member on top of said first compressible filler member;

positioning said innerspring member inside of said compressible frame member and on top of said first compressible filler member;

positioning a second insulator member on top of said innerspring member;

positioning a second compressible filler member on top of said second insulator member;

permanently securing the bottom of said top panel member to the top of said compressible frame member;

securing said first and second fastening means enclosing said top panel member, said bottom panel member and said compressible frame within a covering means;

wherein said innerspring member, said bottom panel member, and said first insulator member each remain upright during each of said steps of positioning said first compressible filler member on top of said bottom panel member, and positioning of said innerspring member inside of said compressible frame member, and securing said compressible frame member to said top panel member;

wherein said compressible frame remains substantially upright during said step of enclosing said top panel member, said bottom panel member, said compressible frame member, and said innerspring member within a covering means."

* * * * *